US006325037B1

(12) United States Patent
Takahashi et al.

(10) Patent No.: US 6,325,037 B1
(45) Date of Patent: Dec. 4, 2001

(54) CRANKCASE ARRANGEMENT FOR ENGINE

(75) Inventors: Masanori Takahashi; Hitoshi Watanabe, both of Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/629,555

(22) Filed: Jul. 31, 2000

(30) Foreign Application Priority Data

Jul. 30, 1999 (JP) ..... 11-216563

(51) Int. Cl.[7] ..... F01M 1/06

(52) U.S. Cl. ..... 123/195 P; 123/195 HC; 123/196 W

(58) Field of Search ..... 123/195 P, 195 R, 123/195 C, 195 HC, 196 R, 196 CP, 196 W

(56) References Cited

U.S. PATENT DOCUMENTS

| | | | | |
|---|---|---|---|---|
| 4,616,610 | * | 10/1986 | Ishida | 123/196 A |
| 5,009,205 | * | 4/1991 | Abe et al. | 123/195 H |
| 5,461,940 | * | 10/1995 | Morita | 123/192.2 |
| 5,572,959 | * | 11/1996 | Hedelin | 123/48 C |
| 5,687,686 | | 11/1997 | Takahashi . | |
| 5,752,866 | * | 5/1998 | Takahashi et al. | 123/195 HC |
| 5,778,847 | | 7/1998 | Takahashi et al. . | |
| 5,890,461 | * | 4/1999 | Iikura | 123/41.82 R |
| 5,904,604 | * | 5/1999 | Suzuki et al. | 123/195 P |
| 5,941,205 | | 8/1999 | Hiraoka et al. . | |

FOREIGN PATENT DOCUMENTS

| | | |
|---|---|---|
| 9-273406 | 10/1997 | (JP) . |
| 9-273407 | 10/1997 | (JP) . |

* cited by examiner

*Primary Examiner*—Marguerite McMahon
(74) *Attorney, Agent, or Firm*—Knobbe, Martens Olson & Bear LLP

(57) ABSTRACT

A crankcase arrangement for an engine includes an improved construction that allows lubricant to more freely flow through the crankcase and to quickly return to a lubricant reservoir even though the engine has a compact construction. A cylinder body of an exemplifying engine includes at least an upper bearing portion, intermediate bearing portion and lower bearing portion. A crankcase member, which defines a crankcase cavity with the cylinder body, includes an upper bearing section and a lower bearing section. An upper main bearing journal of a crankshaft is rotatably journaled between the upper bearing portion and the upper bearing section and a lower main bearing journal of the crankshaft is rotatably journaled between the lower bearing portion and the lower bearing section. A bearing cap is arranged to rotatably journal the crankshaft with the intermediate bearing portion. In a preferred form, the bearing cap includes a plurality of cap sections that are joined together. Each cap section cooperates with a corresponding intermediate bearing portion of the cylinder body. Intermediate main bearings, which are formed by the cooperating cap sections and intermediate bearing portions, journal the crankshaft at a plurality of locations between the upper and lower main bearing journals of the crankshaft.

25 Claims, 6 Drawing Sheets

CRANKCASE ARRANGEMENT FOR ENGINE

PRIORITY INFORMATION

This invention is based on and claims priority to Japanese Patent Applications No. Hei 11-216563, filed Jul. 30, 1999.

BACKGROUND OF THE INVENTION

1. Field of the Invention

This invention relates to a crankcase arrangement for an engine, and more particularly relates to a crankshaft bearing structure suitable for a vertically oriented engine.

2. Description of Related Art

A typical outboard motor employs an internal combustion engine disposed within a power head of the motor. The engine includes a crankshaft that extends generally vertically. The crankshaft is confined in a crankcase cavity defined by a cylinder body and a crankcase member, and is rotatably journaled by a bearing structure formed between the cylinder body and the crankcase member. The bearing structure thus extends generally transversely across an axis of the crankshaft in the crankcase cavity.

The engine normally includes a lubrication system to lubricate various moving portions of the engine. The crankshaft bearing structure is one of such portions that need lubrication. Lubricant (e.g., oil) often is supplied to the crankshaft bearing structure from a lubricant reservoir by a lubricant pump through one or more lubricant passages formed within the cylinder body. The lubricant reservoir is normally disposed in a driveshaft housing of the outboard motor, which depends from a power head, and the crankshaft usually drives the lubricant pump.

The oil lubricates the crankshaft bearing structure and then is spattered toward an internal side wall of the crankcase member by the centrifugal force produced with rotation of the crankshaft. The majority of the lubricant first adheres on the wall and then cascades down to the bottom of the crankcase cavity so as to return to the lubricant reservoir under gravity.

The flow direction of the lubricant, however, is across the transversely extending crankshaft bearing structure. This construction of the bearing structures, which protrudes from the sidewall of the crankcase member, blocks the lubricant from flowing downwardly to the lubricant reservoir.

In one prior arrangement, such as that disclosed by Japanese Laid-Open Patent Publication No. Hei 09-273406, through-holes are provided in the respective bearing sections adjacent to the sidewall of the crankcase member so as to permit the lubricant to fall more freely towards the bottom of the crankcase. Japanese Laid-Open Patent Publication No. Hei 09-273407 discloses another arrangement to address the foregoing problem. In this arrangement, a bearing cap is provided separately from a crankcase member and a lubricant return passage is defined between the bearing cap and the crankcase member. Both constructions, however, suffer from other disadvantages.

If, in the arrangement of the former publication, the through-holes were large enough to produce a generally free flow of the lubricant, the rigidity of the bearing sections would be significantly reduced and the bearing structure would be weakened. Such Large holes in the slender section of the bearing section would weaken these structures. Conversely, smaller holes would not permit the lubricant to return quickly to the lubricant reservoir. The quick return of the lubricant to a lubricant reservoir is required because the lubricant must be recycled through the engine.

In the latter arrangement, the uppermost and lowermost bearing sections are slender. While this construction affords some clearance between the bearing cap and the crankcase member without increasing the height of the engine, it also weakens the bearing upper and lower bearing structure.

A need therefore exists for an improved crankshaft bearing structure for an engine that can allow the lubricant to return quickly to the lubricant reservoir from the crankcase even though the engine has a compact structure.

SUMMARY OF THE INVENTION

In accordance with one aspect of the present invention, an internal combustion engine comprises a cylinder body, a crankcase member, a crankshaft and a bearing cap. The crankcase member defines a crankcase chamber with the cylinder body. The crankshaft extends within the crankcase chamber. The cylinder body includes at least a first bearing portion, an intermediate bearing portion and a second bearing portion. The crankcase member includes a first bearing section and a second bearing section. The cylinder body and the crankcase member rotatably journal the crankshaft between the upper bearing portion and the upper bearing section and also between the lower bearing portion and the lower bearing section. The bearing cap cooperates with the intermediate bearing portion to further rotatably journal the crankshaft within the crankcase. The bearing cap can be attached to the cylinder body apart from the crankcase member.

In accordance with another aspect of the present invention, a crankshaft bearing arrangement is provided for an internal combustion engine. The engine has a cylinder body and a crankcase member. The crankshaft bearing arrangement comprises a bearing cap and a plurality of fasteners. The cylinder body, the crankcase member and some of the fasteners form a first bearing unit. The cylinder body, the bearing cap and the rest of the fasteners form a second bearing unit.

In accordance with a further aspect of the present invention, a method is provided for supporting a crankshaft in an internal combustion engine. The method comprises affixing a bearing cap to a cylinder body so as to rotatably journal a crankshaft between the cylinder body and the bearing cap. The method further comprises affixing the crankcase member to the cylinder body so as to further rotatably journal the crankshaft between the cylinder body and the crankcase member.

Further aspects, features and advantages of this invention will become apparent from the detailed description of the preferred embodiment that follows.

BRIEF DESCRIPTION OF THE DRAWINGS

These and other features of this invention will now be described with reference to the drawings of a preferred embodiment, which is intended to illustrate and not to limit the invention. The drawings contain the following figures.

DETAILED DESCRIPTION OF THE PREFERRED EMBODIMENT OF THE INVENTION

Figure 1:
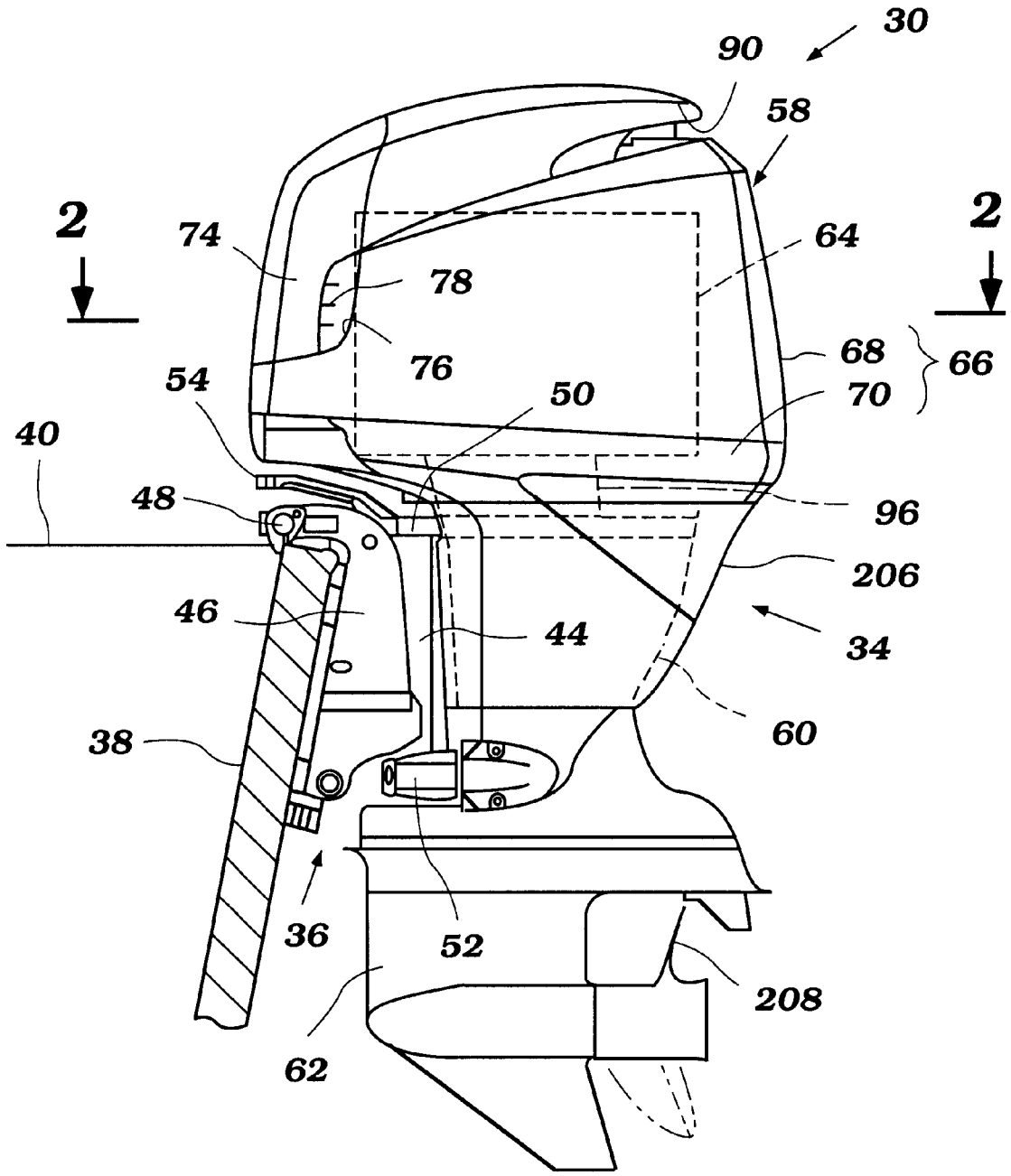
FIG. 1 is a side elevational view of an outboard motor employing an engine that includes a crankshaft bearing structure configured in accordance with a preferred embodiment of the present invention.

With reference to FIGS. 1 to 6, an outboard motor 30 incorporates a crankshaft bearing structure 32 (see FIGS. 5 and 6) configured in accordance with a preferred embodiment of the present invention. Although the present invention is shown in the context of an engine for an outboard motor, various aspects and features of the present invention also can be employed with engines for other types of marine drive units (e.g., a stem drive unit or a jet pump) and also with other types of engines (e.g., land vehicle engines and stationary engines). Thus, while the crankshaft bearing structure has particular utility when used with engines that have a generally vertical orientation (i.e., have a vertically oriented crankshaft axis), the various aspects, features and advantages of the crankshaft bearing structure can be used with engines having different orientations (e.g., with an engine having a generally horizontally extending crankshaft axis, such at that employed in a personal watercraft).

In the illustrated embodiment, the outboard motor 30 comprises a drive unit 34 and a bracket assembly 36. The bracket assembly 36 supports the drive unit 34 on a transom 38 of an associated watercraft 40 so as to place a marine propulsion device in a submerged position with the watercraft 40 resting on the surface of a body of water. The bracket assembly 36 comprises a swivel bracket 44, a clamping bracket 46, a steering shaft and a pivot pin 48.

The steering shaft extends through the swivel bracket 44 and is affixed to the drive unit 34 with an upper mount assembly 50 and a lower mount assembly 52. The steering shaft is pivotally journaled for steering movement about a generally vertically extending steering axis within the swivel bracket 44. A steering handle 54 extends upwardly and forwardly from the steering shaft to steer the drive unit 34. The clamping bracket 46 includes a pair of bracket arms spaced apart from each other and affixed to the transom 38 of the associated watercraft 40. The pivot pin 48 completes a hinge coupling between the swivel bracket 44 and the clamping bracket 46. The pivot pin 48 extends through the bracket arms so that the clamping bracket 46 supports the swivel bracket 38 for pivotal movement about a generally horizontally extending tilt axis of the pivot pin 48.

As used through this description, the terms "fore," "front," forward" and "forwardly" mean at or to the side where the clamping bracket 46 is located, and the terms "aft," "rear," "reverse" and "rearwardly" mean at or to the opposite side of the front side, unless indicated otherwise or otherwise readily apparent from the context of use.

Although not shown, a hydraulic tilt and trim adjustment system is provided between the swivel bracket 44 and clamping bracket 46 to tilt up and down and also for the trim adjustment of the drive unit 34. Since the construction of the bracket assembly 36 is well known in the art, a further description is not believed to be necessary to permit those skilled in the art to practice the invention.

The drive unit 34 includes a power head 58, a driveshaft housing 60 and a lower unit 62. The power head 58 is disposed atop the drive unit 34 and includes an internal combustion engine 64 and a protective cowling assembly 66. The protective cowling assembly 66 includes a top cowling member 68 and a bottom cowling member 70.

The protective cowling assembly 66 generally completely encloses the engine 64. The top cowling member 68 is detachably affixed to the bottom cowling member 70 with a conventional coupling mechanism 72 (see FIGS. 3 and 4) so that the operator can access the engine 64 for maintenance or for other purposes.

Figure 2:
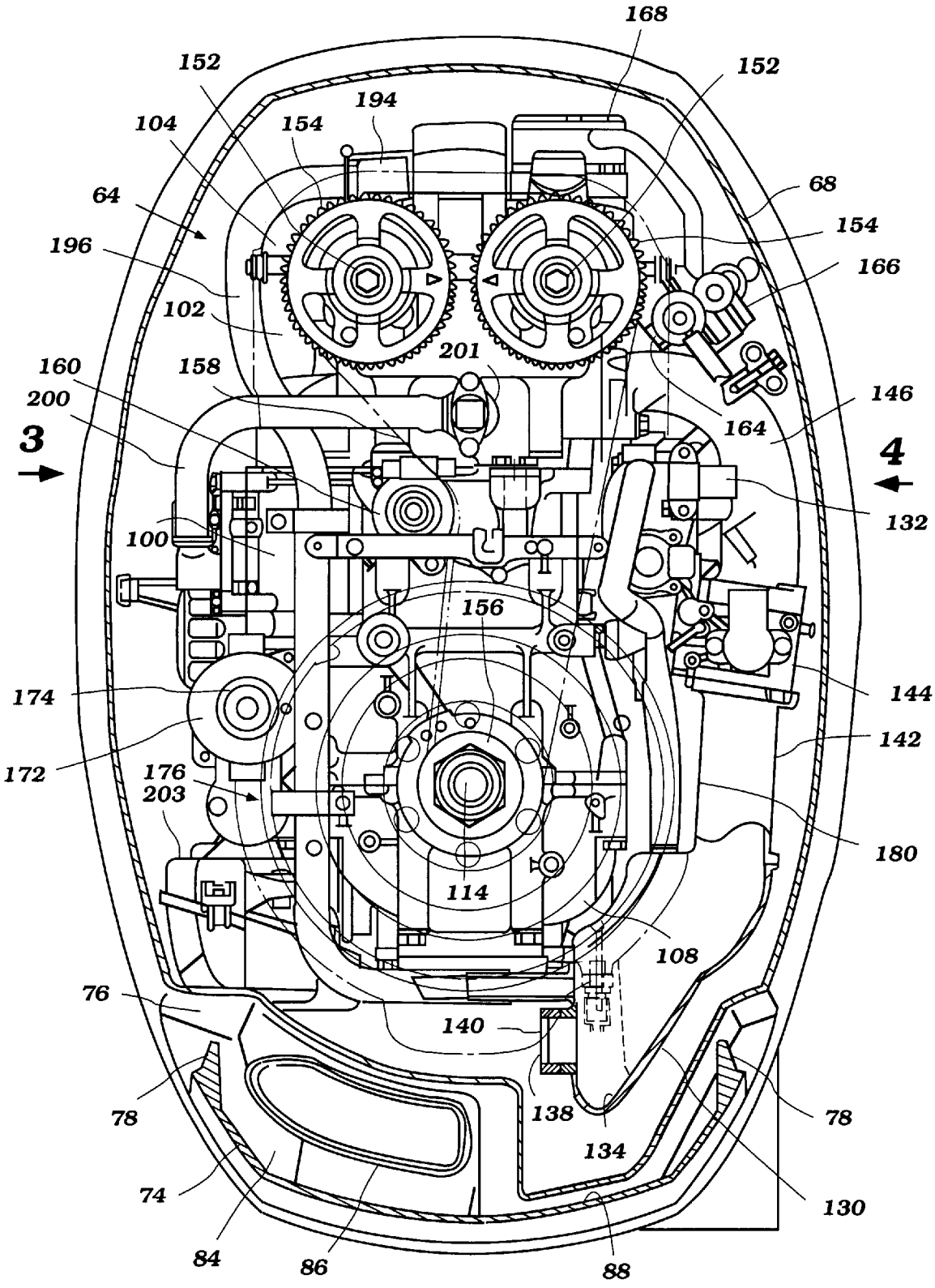
FIG. 2 is a top plan view of a power head of the outboard motor. A top cowling member of the power head is shown in section along the line 2-2 of FIG. 1. An air induction system is also partially sectioned.

In the illustrated embodiment, the top cowling member 68 has a separate front cover 74, which is detachably affixed to the top cowling 68. Front air intake openings 76 are formed on both sides of the power head 58 and between the top cowling member 68 and the front cover 74. As seen in FIGS. 1 and 2, the front cover 74 has a plurality of projections 78 extending rearwardly to inhibit water and substances other than air from entering a closed internal cavity of the cowling assembly 66.

Figure 3:
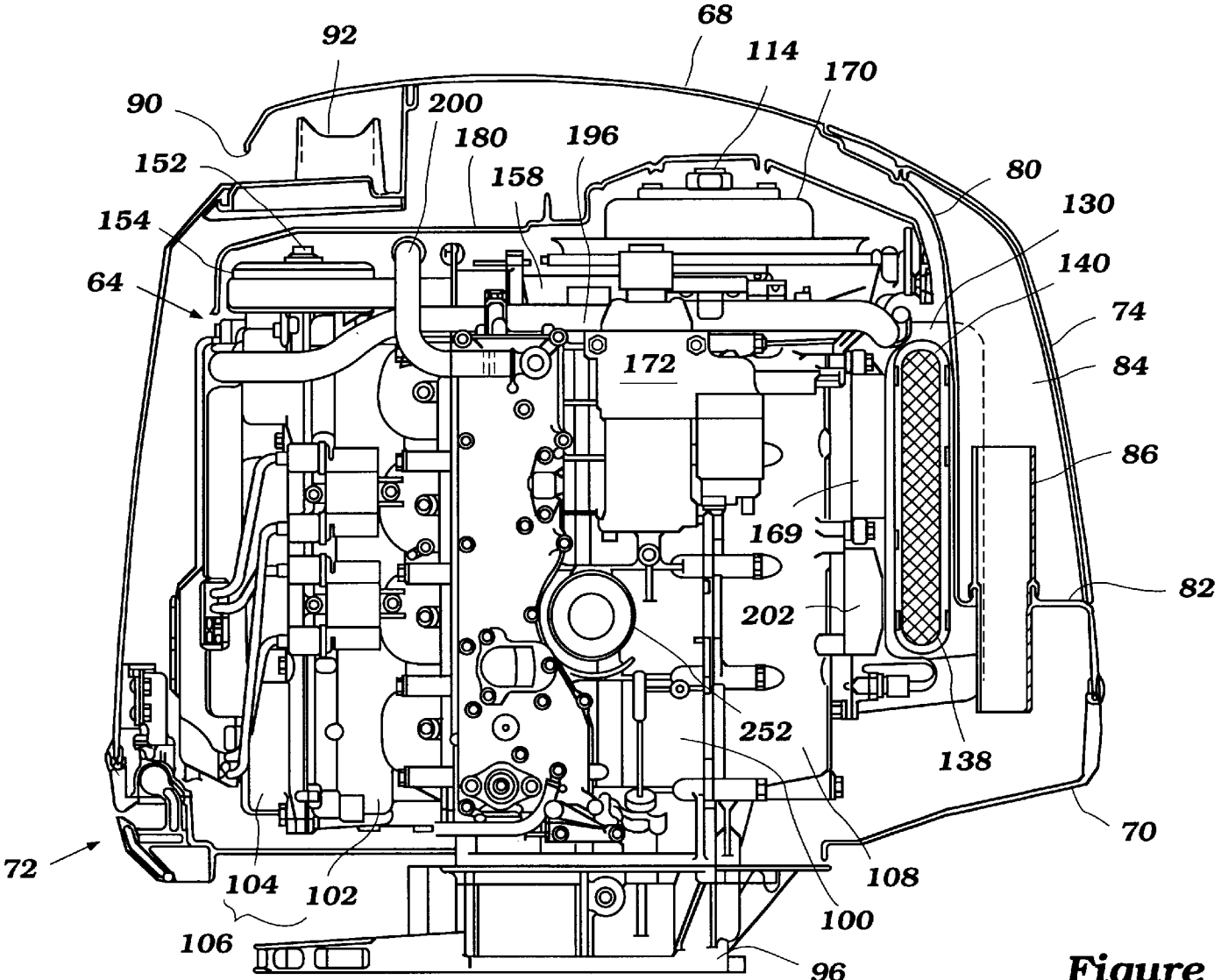
FIG. 3 is a side elevational view of the power head as viewed in the direction of the Arrow 3 of FIG. 2 to show the starboard side of the engine. The top cowling member is shown in section generally along a centerline of the cowling member and also along a line crossing a front air duct.

As best seen in FIG. 3, a front end of the top cowling member 68 is recessed and its vertically extending portion 80 and bottom portion 82 together define a front air compartment 84 with the front cover 74. The bottom portion 82 has a through-hole that holds a front air duct 86. An upper portion of the air duct 86 extends in the air compartment 84 with a certain length, while a lower portion thereof extends in the cavity of the cowling assembly 66 also with a certain length. Ambient air can enter the cavity of the cowling assembly 66 through the front air intake openings 76 and the front air duct 86. As seen in FIG. 2, the front air duct 86 is actually partial to the starboard side and hence the intake opening 76 on the port side is coupled to the air compartment 84 through a channel 88.

The top cowling member 68 also has a rear air intake opening 90 disposed on its rear and top portion. A pair of rear air ducts 92 is provided adjacent to the opening 90 so that ambient air also can enter the cavity of the cowling assembly 66 through the opening 90 and the ducts 92.

The bottom cowling member 70 has an opening at its bottom portion through which an exhaust guide member 96 extends. The exhaust guide member 96 is affixed atop the driveshaft housing 60. The bottom cowling member 70 and the exhaust guide member 96, thus, generally form a tray. The engine 64 is placed onto this tray and is affixed to the exhaust guide member 96 so as to be supported thereby. The exhaust guide member 96 also has an exhaust passage therein, through which a burnt charge (e.g., exhaust gases) from the engine 64 is discharged as described below.

The engine 64 in the illustrated embodiment operates on a four-stroke combustion principle and powers a propulsion device. The engine 64 has a cylinder body 100. Although not shown, the cylinder body 100 defines four cylinder bores which generally horizontally extends and which are spaced generally vertically apart from each other. That is, the engine 64 is an (in-line four cylinder) type. This type of engine, however, is merely exemplary of a type on which various aspect and features of the present invention can be used. Engines having other number of cylinders and other cylinder arrangements are all practicable.

A piston reciprocates in each cylinder bore. A cylinder head member 102 is affixed to one end of the cylinder body 100 and a cylinder head cover member 104 is affixed to cover the cylinder head member 102. The cylinder head member 102 and cylinder head cover member 104 together form a cylinder head assembly 106. The cylinder head member 102 defines four combustion chambers with the cylinder bores and pistons.

Figure 5:
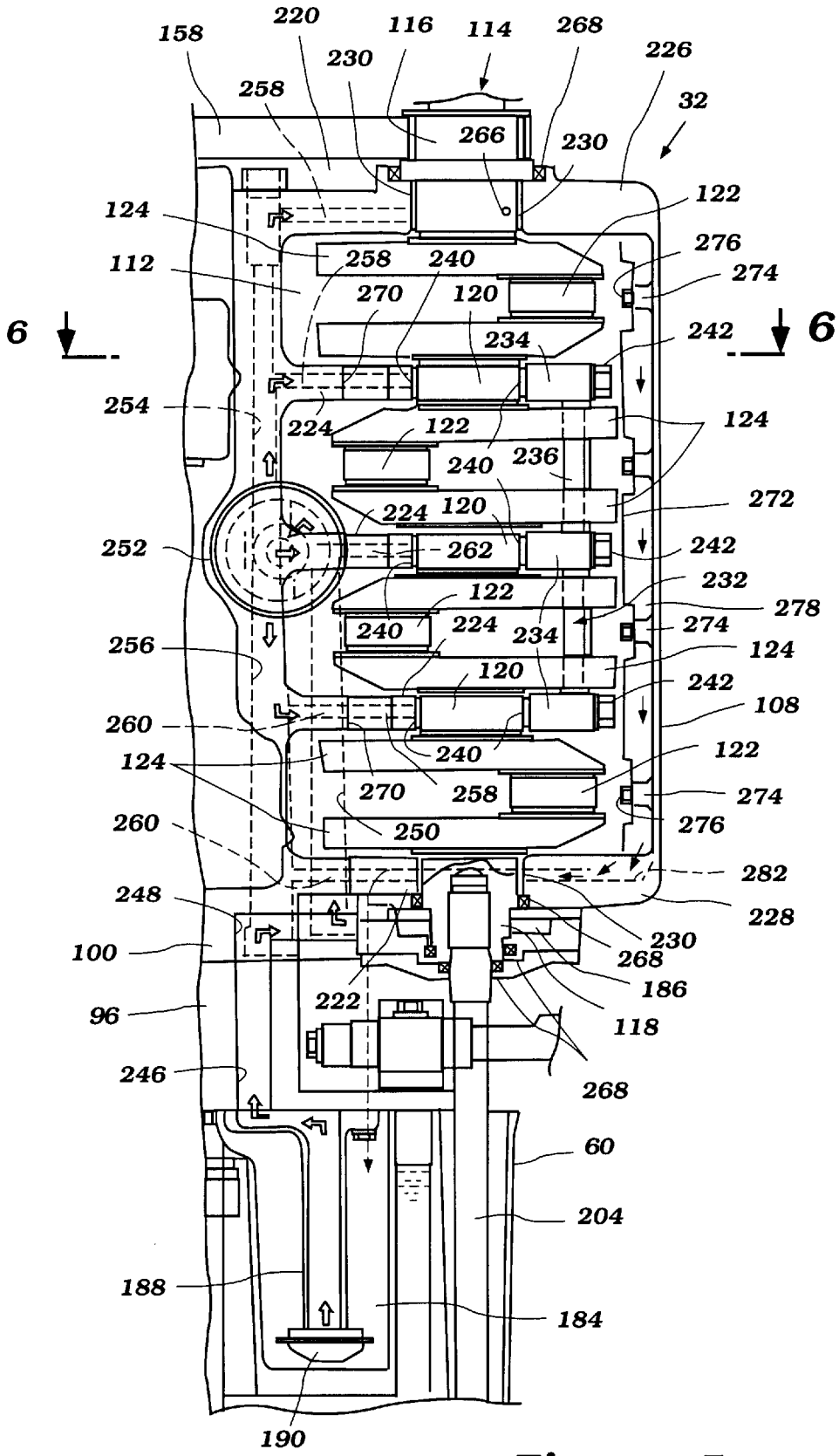
FIG. 5 is an enlarged sectional side elevational view of a crankshaft bearing structure of the engine. Sectional cross-hatching of some engine components has been omitted to simplify the drawing. Part of a top portion of a driveshaft, which includes a lubricant reservoir, is also shown.

As best seen in FIG. 5, the other end of the cylinder body 100 is closed with a crankcase member 108 that defines a crankcase cavity 112 with the cylinder body 100. A crankshaft 114 extends generally vertically through the crankcase cavity 112.

The crankshaft 114 comprises a top main journal 116, a bottom main bearing journal 118, one or more intermediate main bearing journals 120, connecting rod journals 122 and counter weights 124. The upper, bottom and intermediate main bearing journals 116, 118, 120 are journaled between the cylinder body 100 and the crankcase member 108, as will be described in greater detail with reference to FIGS. 5 to 7 below. The crankshaft 114 is rotatably connected to the pistons by connecting rods and rotates with the reciprocal movement of the pistons. Although the pistons and connecting rods are not shown in FIG. 5, the big ends of the connecting rods are coupled to the rod journals 122 via metal bearing members so as to fit snugly. The counter weights 124 are provided oppositely relative to the rod journals 122 and at both sides of each rod journal 122 so as to balance with the weight of the rod journal 122 that bears the connecting rod.

The crankcase member 108 is located at the most forward position, then the cylinder body 100 and the cylinder head assembly 106 extend rearwardly from the crankcase member 108 one after another.

The engine 64 includes an air induction system and an exhaust system. The air induction system is arranged to supply air to the combustion chambers and comprises a plenum chamber member 130, air delivery conduits 132 and intake ports. The intake ports are defined in the cylinder head assembly 106 and are opened and closed by intake valves. When each intake port is opened, the corresponding air delivery conduit 132 communicates with the associated combustion chambers.

The plenum chamber member 130 is mounted on the port side of the crankcase member 108. The plenum chamber member 130 defines a plenum chamber 134 that functions as an intake silencer and a coordinator of air charges. The air delivery conduits 132 extend rearwardly from the plenum chamber member 130 along the cylinder body 100 on the port side and then bend toward the intake ports.

The plenum chamber member 130 has an air inlet 138. A filter 140 is provided to cover the opening of the air inlet 138. In the illustrated embodiment, the filter 140 is a fine metal or meshed metal formed by a plurality of crossing wires. Thus, the filter 140 can not only inhibit foreign substances other than air from entering the plenum chamber 134 but also arrest backfire flames from the combustion chambers.

Figure 4:
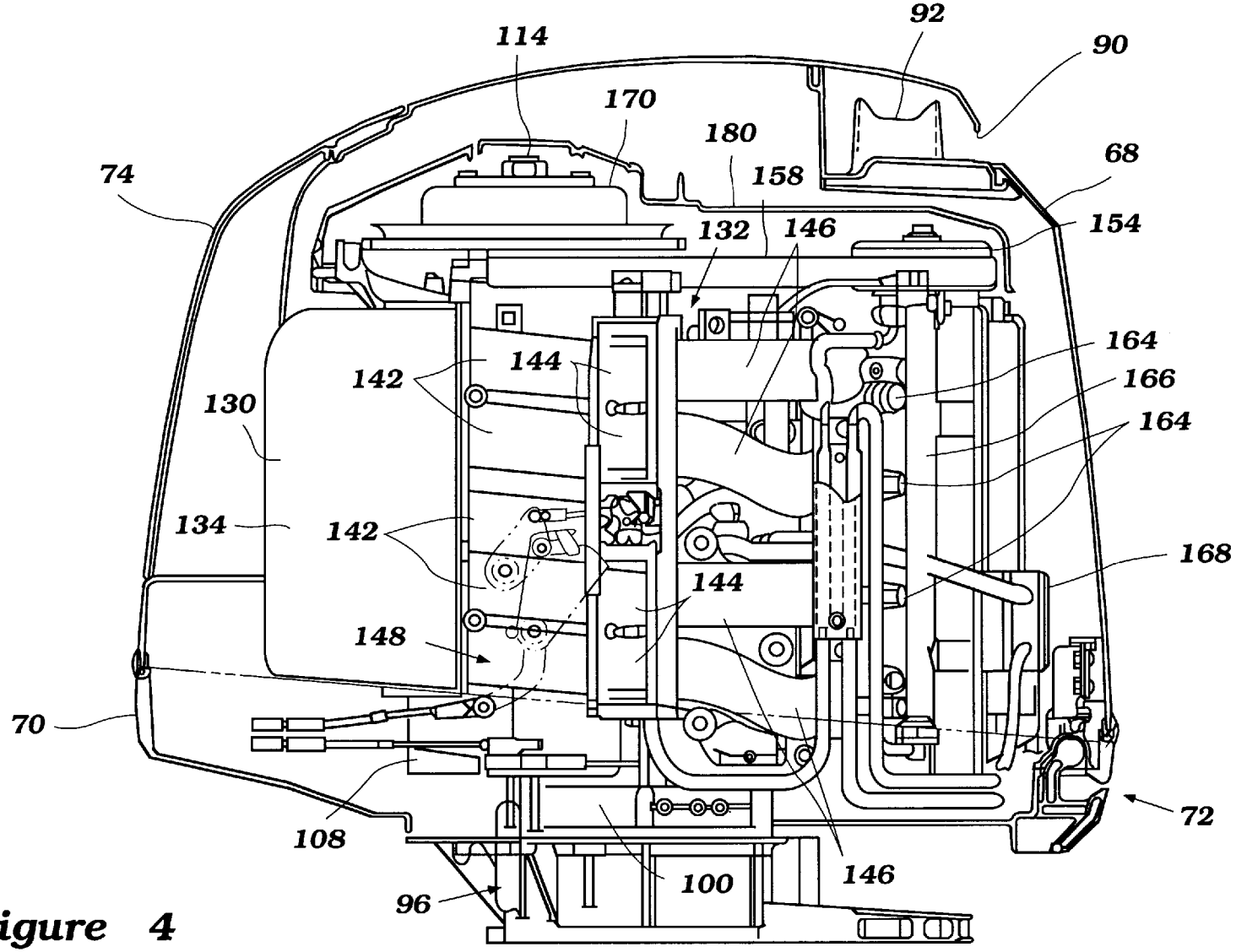
FIG. 4 is a side elevational view of the power head as viewed in the direction of the Arrow 4 of FIG. 2 to show the port side of the engine. The top cowling member is shown in section generally along the centerline of the cowling member.

As best seen in FIG. 4, the air delivery conduits 132 are preferably defined by delivery ducts 142, throttle bodies 144 and runners 146. The throttle bodies 144 are unified with each other and are affixed to the cylinder body 100. The delivery ducts 142 connect the plenum chamber member 130 to the throttle bodies 144, while the runners 146 connect the throttle bodies 144 to the cylinder head assembly 106 so that the plenum chamber 134 communicates with the intake ports via passages defined in the throttle bodies 144.

The respective throttle bodies 144 support throttle valves therein for pivotal movement about axes of valve shafts that extend generally vertically. The valve shafts are linked together to form a single valve shaft that passes through the entire assembly of the throttle bodies 144. The throttle valves are operable by the operator through a suitable throttle cable and a linkage mechanism 148.

When the operator operates the throttle cable, the linkage mechanism 148 activates the valve shaft to open the throttle valves. Conversely, when the throttle cable is released, the linkage mechanism 148 moves the valve shaft to close the throttle valves.

The exhaust system is arranged to discharge burnt charges or exhaust gases outside of the outboard motor 30 from the combustion chambers. Exhaust ports are defined in the cylinder head assembly 106 and are opened and closed by exhaust valves. When the exhaust ports are opened, the combustion chambers communicate with exhaust passages, which lead the exhaust gases downstream of the exhaust system.

Two camshafts 152 extend generally vertically within the cylinder head assembly 106 to actuate the intake and exhaust valves. The camshafts 152 have cam lobes thereon to push the intake and exhaust valves at certain timings to open and close the respective intake and exhaust ports. The camshafts 152 are journaled on the cylinder head assembly 106 and are driven by the crankshaft 114. The respective camshafts 152 have sprockets 154 thereon, while the crankshaft 114 also has a sprocket 156 thereon. A cogged belt or timing chain 158 is wound around the sprockets 154, 156. With rotation of the crankshaft 114, the camshafts 152 also rotate. A tensioner 160 is provided to adjust the tension of the belt or chain 158 by pushing it inwardly so as to keep the opening and closing timing of the intake and exhaust valves accurate. The tensioner 160 includes, for example, a gas cylinder containing compressed gases therein to produce the tensioning force.

In the illustrated embodiment, the engine 64 has a fuel injection system, although other conventional fuel supply and charge forming systems can be applied. The fuel injection system includes four fuel injectors 164, which have injection nozzles directed toward the respective intake ports. The fuel injectors 164 are supported by a fuel rail 166 that is affixed to the cylinder head member 102. The fuel injection system further includes a vapor separator, a first low pressure fuel pump or manual pump, a second low pressure fuel pump 168, a high pressure fuel pump, a pressure regulator, a fuel supply tank and several fuel conduits connecting those components. The fuel supply tank and manual pump are disposed on a hull of the watercraft 40 and the other components described above are placed on the outboard motor 30. The amount of fuel injected and injection timing are controlled by an ECU (Electronic Control Unit) 169, which is shown in FIG. 3.

Although not specifically shown, the engine 64 further includes an ignition or firing system. Four spark plugs are mounted on the cylinder head member 102 so as to expose electrodes to the respective combustion chambers. The spark plugs can be installed onto and removed from the rear of the engine 64 by detaching the top cowling member 68 from the bottom cowling member 70. The spark plugs fire an air/fuel charge at a proper timing. This firing timing is also controlled by the ECU 169. The air/fuel charge is formed with the air supplied by the air induction system and the fuel sprayed by the fuel injectors 164 of the fuel injection system. The burnt charge or exhaust gases are discharged outside through the exhaust system as described above.

A flywheel assembly 170 is affixed atop the crankshaft 114. The flywheel assembly 170 includes a generator to supply electric power to the firing system, to the ECU 169 and to other electrical equipment via a battery and/or directly. The battery is normally disposed in the hull of the watercraft 40.

A starter motor 172 is affixed on the cylinder body 100 adjacent to the flywheel assembly 170. A gear 174 of the starter motor 172 meshes with a ring gear 176 that is provided on a periphery of the flywheel assembly 170 through a one-way clutch. The starter motor 172 rotates the crankshaft 114 via the flywheel assembly 170 when the operator operates a main switch. Because, however, the starter gear 174 and the ring gear 176 are coupled together by the one-way clutch, the crankshaft 114 cannot rotate the starter motor 172 immediately after starting the engine 64.

A protector 180 covers the flywheel assembly 170, starter motor 172, sprockets 154, 156 and the belt 158 for protection of the operator from such moving parts.

The engine 64 also includes a lubrication system. As seen in FIG. 5, a lubricant reservoir 184 depends from the exhaust guide member 96 and is disposed within the driveshaft housing 60. A lubricant pump 186, which is coupled to and driven by the crankshaft 114, supplies lubricant to various engine components.

Such engine components include the pistons that reciprocate within the cylinder bores. The pistons need the lubrication so as not to seize on surfaces of the cylinder bores. Piston rings are provided on the pistons to isolate the combustion chambers from the crankcase chamber. At least one piston ring can remove the lubricant from the surface of the cylinder bore and carry it out to the crankcase cavity.

The engine components that need lubrication further include the crankshaft bearing structure 32. A suction pipe 188 is provided for delivering the lubricant to the crankshaft bearing structure 32 from the lubricant reservoir 184. A filter 190 is attached to an inlet portion of the suction pipe 188 for removing foreign substances. The lubricant flows through lubricant delivery channels formed in the crankshaft bearing structure 32. Some of the lubricant is delivered to the pistons so as to lubricate them as described above. The lubricant then returns to the lubricant reservoir 184. The lubricant delivery channels and the lubrication process will be described in greater detail shortly.

Unburnt charges containing a small amount of the exhaust gas may leak to the crankcase chamber from the combustion chambers as blow-by gas because of the huge pressure generated therein, although the piston rings isolate them. The engine 64 has a ventilation system that delivers the blow-by gases to the air induction system to burn them in the combustion chambers.

The ventilation system comprises an inner blow-by gas conduit, an oil separator or breather 194 and an outer blow-by gas conduit 196. The inner conduit is formed internally of the crankcase member 108, cylinder body 100 and cylinder head assembly 106 and connects the crankcase cavity to the oil separator 194. The oil separator 194 is mounted on the cylinder head cover member 104 and has a labyrinth structure therein to separate the oil component from the blow-by gases. The outer blow-by gas conduit 196 couples the oil separator 194 to the plenum chamber member 130 so as to supply the blow-by gases to the induction system.

The engine 64 further has a cooling system that provides coolant to engine portions, for example, the cylinder body 100 and the cylinder head assembly 106, and also to the exhaust system because they accumulate significant heat during engine operations. In the illustrated embodiment, water is used as the coolant is introduced from the body of water surrounding the outboard motor 30.

The water introduced into the cooling system is delivered to the engine portions through cooling water jackets. After cooling them, the water is discharged outside through a discharge conduit 200 and a water discharge jacket formed in the cylinder body 100. A thermostat 201 is provided at the most upstream portion of the discharge conduit 200. If the temperature of the water is lower than a preset temperature, the thermostat 201 will not allow the water to flow out to the discharge conduit 200 so that the engine 64 can warm up properly.

Additionally, the engine 64 in the embodiment has a number of engine-related components that are mounted onto the engine 64 or provided adjacent to the engine 64. For example, an electric power source box 202 (see FIG. 3) and a relay box 203 (see FIG. 2) are mounted on the engine 64 at proper locations.

With reference back to FIG. 1, the driveshaft housing 60 depends from the power head 58 and supports a driveshaft 204 (see FIG. 5) which is driven by the crankshaft 114 of the engine 64. An upper portion of the driveshaft housing 60 surrounds the lubricant reservoir 184. The driveshaft 172 extends generally vertically through the exhaust guide member 96 and then through the driveshaft housing 60. The driveshaft housing 60 also defines internal passages that form portions of the exhaust system. An idle exhaust passage is branched off from one of the internal passages and opens to the atmosphere above the body of water. In the illustrated embodiment, an apron 206 covers the upper portion of the driveshaft housing 60. The idle exhaust passage extends through both an outer surface of the driveshaft housing 60 and the apron 206.

The lower unit 62 depends from the driveshaft housing 60 and supports a propulsion shaft, which is driven by the driveshaft 204. The propulsion shaft extends generally horizontally through the lower unit 62. In the illustrated embodiment, the propulsion device supports a propeller 208 that is affixed to an outer end of the propulsion shaft and is driven thereby. The propulsion device, however, can take the form of a dual, counter-rotating system, a hydrodynamic jet, or like propulsion devices.

A transmission is provided between the driveshaft 204 and the propulsion shaft. The transmission couples together the two shafts which lie generally normal to each other (i.e., at a 90° shaft angle) with a bevel gear train or the like. The transmission has a switchover or clutch mechanism to shift rotational directions of the propeller 208 to forward, neutral or reverse. The switchover mechanism is operable by the operator through a shift linkage including a shift cam, a shift rod and a shift cable.

The lower unit 62 also defines an internal passage that forms a discharge section of the exhaust system. At engine speed above idle, the majority of the exhaust gases are discharged toward the body of water through the internal passage and a hub of the propeller 208. At the idle speed of the engine 64, the exhaust gases can be discharged only through the idle exhaust passage because the exhaust pressure under this condition is smaller than the backpressure created by the body of water.

Additionally, the driveshaft housing 60 has a water pump that is driven by the driveshaft 204 and supplies water to the cooling system. Water is introduced through a water inlet (not shown) which opens at the lower unit 62. The water inlet is connected to the water pump through an inlet passage, while the water pump is connected to the engine portions and the exhaust system.

Still with reference to FIG. 5 and additionally to FIGS. 6 and 7, the crankshaft bearing structure 32, the lubricant delivery channels and lubrication process will now be described. The cylinder body 100 has a top bearing portion 220, a bottom bearing portion 222 and three intermediate bearing portions 224. These bearing portions 220, 222, 224 extend generally horizontally toward the crankcase member 108 and are generally vertically spaced apart from each other. In the illustrated embodiment, the distances between the respective bearing portions 220, 222, 224 are all equal. The crankcase member 108 has a top bearing section 226 and a bottom bearing section 228. These bearing sections 226, 228 extend generally horizontally toward the cylinder body 100 so that the top bearing section 226 meets with the top bearing portion 220 and the bottom bearing section 228 meets with the bottom bearing portion 222. The respective end surfaces of the bearing portions 220, 222, 224 and the bearing sections 226, 228 preferably are configured as semicircular concave so as to receive the top main bearing journal 116 and the bottom main bearing journal 118 of the crankshaft 114, which each have a cylindrical shape. Metal bearing inserts 230, which are configured as semicircular shapes, are fitted into the respective end surfaces of the bearing portions 220, 222, 224 and also the respective end surfaces of the bearing sections 226, 228 so as to rotatably support the main journals 116, 118 therebetween to reduce frictional wear. The top and bottom bearing sections 226, 228 of the crankcase member 108 are rigidly affixed to the top and bottom bearing portions 220, 222 of the cylinder body 100, respectively, by fasteners (e.g., bolts).

In the illustrated embodiment, a bearing cap unit 232 is provided as a counterpart to the intermediate bearing portions 224. That is, the bearing cap 232 has three cap sections 234 that meet with the respective intermediate bearing portions 224. As seen in FIG. 7, the three cap sections 234 are unified together by a pair of connecting portions 236. In the illustrated embodiment, each cap section 234 has two bolt holes 238. Like the bearing sections 226, 228, the respective end surfaces of the cap sections 234 are configured as semicircular concave so as to receive the intermediate main journals 120 of the crankshaft 114 that are also configured as cylindrical shapes. Metal bearing inserts 240, which are similar to the bearing inserts noted above, are fitted into the respective end surfaces of the cap sections 234 and also respective end surfaces of the intermediate bearing portions 224 so as to rotatably support the intermediate main journals 120 therebetween also to reduce frictional wear. The respective cap sections 234 of the bearing cap unit 232 are rigidly affixed to the intermediate bearing portions 224 of the cylinder body 100 by bolts 242 that are fitted into the bolt holes 238. Other conventional fasteners can of course be used to join the bearing cap unit to the cylinder body 100.

In accordance with a preferred method of assembling the crankshaft bearing structure 32, the crankshaft 114 is first placed onto the cylinder body 100 so that the main journals 116, 118, 120 of the crankshaft 114 face with the respective bearing portions 220, 222, 224 of the cylinder body 100. Next, the bearing cap unit 232 is placed onto the crankshaft 114 so that the respective cap sections 234 face the intermediate main journals 120 and affixed to the cylinder body 100 by the bolts 242. The crankcase member 108 is then placed onto the cylinder body 100 with the crankshaft 114 interposed therebetween so that the upper and lower bearing sections 226, 228 face the upper and lower main journals 116, 118 of the crankshaft 114. Finally, the crankcase member 108 is affixed to the cylinder body 100 by, for example, bolts.

When assembled, a space exists between at least a portion of the bearing cap unit and the crankcase member. This space defines a lubricant return passage. In the illustrated embodiment, this space is defined on three sides of the bearing cap unit (front, port and starboard). But it is understood that such a space can be formed on only one or two sides, rather than all three. In a preferred mode, however, the space is defined at least on the front side so as to accommodate a lubricant guide plate, as will be described below.

As seen in FIG. 5, the exhaust guide member 96 has a lubricant delivery passage 246 that is coupled to the suction pipe 188 in the lubricant reservoir 184. The cylinder body 100 has lubricant delivery passages 248, 250 that are formed internally. The delivery passage 248 is coupled to the delivery passage 246 in the exhaust guide member 96, while the delivery passage 250 is coupled to an inlet port of a lubricant filter 252. The lubricant filter 252 is mounted on the cylinder body 100 so as to remove foreign substances from the lubricant.

The cylinder body 100 further has an upper delivery passage 254 and a lower delivery passage 256, both of which are formed internally and are coupled to an outlet port of the filter 252. The upper delivery passage 254 bifurcates into two branch delivery passages 258 that are formed in the top bearing portion 220 and the uppermost intermediate bearing portion 224, respectively. Both of the branch passages 258 reach the metal bearing inserts 230, 240. The upper delivery passage 254 also bifurcates into two branch delivery passages 260 that are formed in the bottom bearing portion 222 and the lowermost intermediate bearing portion 224, respectively. Both of the branch passages 260 also reach the metal bearing inserts 230, 240. One more branch delivery passage 262 is formed in the middle intermediate bearing portion 224 that connects the outlet port of the filter 252 to a portion where the metal bearing insert 240 is placed. The metal bearing inserts 230, 240 have through-holes so that the lubricant can reach the respective main journals 116, 118, 120 of the crankshaft 114.

The lubricant therefore lubricates these journaling portions and falls down through the crankcase cavity 112. Some of the lubricant, however, is further delivered to the pistons. For this purpose, the crankshaft 114, connecting rods and pistons have their own lubricant delivery passages formed internally at each of them. One of inlet ports of these delivery passages is shown at the top main journal 116 of the crankshaft 114 with the reference numeral 266. Additionally, seal members 268 are provided for inhibiting the lubricant from leaking out.

The lubricant that enters the crankcase cavity 112 falls onto portions of the crankshaft 114 including the counter weights 124 and rod journals 122. Because the crankshaft 114 rotates in a relatively high speed, the lubricant is then spattered toward internal sidewalls of the cylinder body 100 and the crankcase member 108 by the centrifugal force. Vertical openings 270 are formed in the respective bearing portions 222, 224. The lubricant that adheres onto the sidewall of the cylinder body 100 can return to the lubricant reservoir 184 through these openings 270 and return passages (not shown).

In the illustrated embodiment, a lubricant guide plate 272 is provided to separate the lubricant that is spattered toward the sidewall of the crankcase member 108 so that the lubricant will not adhere to the crankshaft 114 again and also for leading the lubricant toward the bottom of the crankcase cavity 112.

A plurality of bosses 274 extends into the crankcase cavity 112 from the sidewall of the crankcase member 108. The guide plate 272 is affixed to these bosses 274 by a plurality of bolts 276. As seen in FIG. 5, the guide plate 272 generally has a rectangular wave-like shape so that most of the plate (except for the portions that abut the bosses 274) can extend toward the crankshaft 114 as much as possible.

Figure 6:
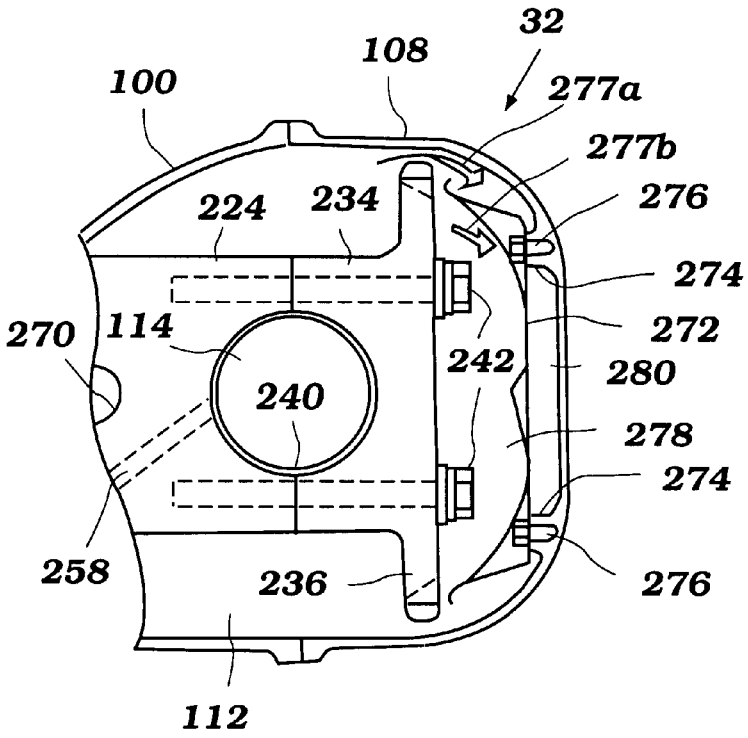
FIG. 6 is an enlarged top plan view of the crankshaft bearing structure shown in section along the lines 6—6 of FIG. 5.
Figure 7:
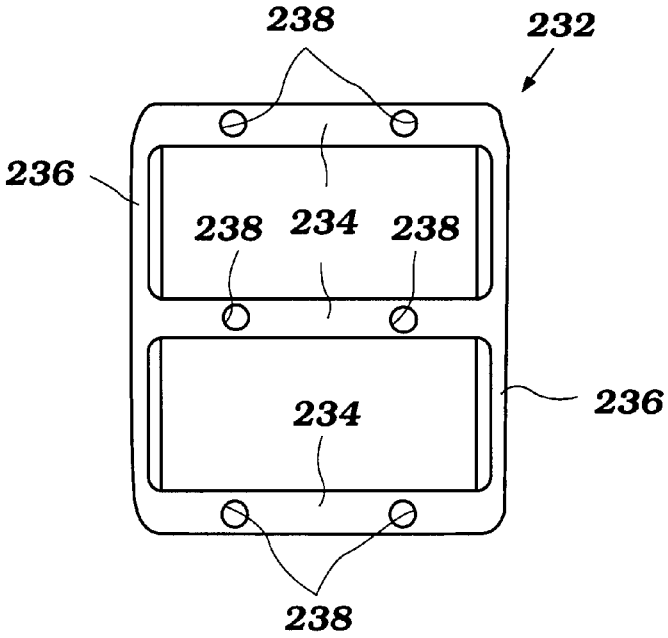
FIG. 7 is a rear view of a bearing cap employed for the crankshaft bearing structure.

Because of this shape and a rotational direction of the crankshaft 114, the guide plate 272 catches the lubricant at its rear side that faces the sidewall as shown by the arrow 277*a* of FIG. 6. Some of the lubricant, however, adheres to the front side of the plate 272 as shown by the arrow 277*b* of FIG. 6. The lubricant therefore falls down primarily through a return passage 278 extending behind the guide plate 272 toward the bottom of the crankcase cavity 112 and also along the front surface of the plate 272. The lubricant then returns back to the lubricant reservoir 184 through a lubricant drain passage 282.

To summarize the lubricant flow, the lubricant pump 186 pulls the lubricant in the lubricant reservoir 184 through the suction pipe 188 and the delivery passages 246, 248, and then pushes it out to the delivery passage 250. The lubricant passes through the filter 252 for removing foreign substances, and is delivered to the respective journaling portions through the respective delivery passages 254, 256 and branch passages 258, 260, 262. After lubricating these journaling portions, some of the lubricant will be further delivered to the pistons. The majority of the lubricant, however, falls down onto the portions of the crankshaft 114 and then is spattered toward sidewalls of the cylinder body 100 and crankcase member 108. The lubricant that goes to the side wall of the cylinder body 100 falls down along a surface of the side wall and then passes through the openings 270 toward the bottom of the crankcase cavity 112 so as to return to the lubricant reservoir 184. The lubricant that goes to the side wall of the crankcase member 108 is caught by the guide plate 272 and then falls down through the return passages 278 formed between the sidewall of the crankcase member 108 and the guide plate 272 or along the front surface of the plate 272 toward the bottom of the crankcase cavity 112 so as to return to the lubricant reservoir 184 also. This circulation continuously repeats as the engine runs.

As described above, the crankshaft bearing structure in the illustrated embodiment has the lubricant return passages that contain no obstructive portions against the return flow of the lubricant. In addition, the top and bottom bearing sections do not themselves define any portion of the return passage. The crankshaft bearing structure can therefore allow the lubricant to flow freely so as to ensure quick return of the lubricant to the lubricant reservoir even though the engine has a compact structure.

Further, when the engine is assembled, the crankshaft is supported solely between the cylinder body and the bearing cap unit before completing the bearing structure by both the bearing cap unit and the crankcase member. This is advantageous because it eases engine assembly. That is, normally, in a conventional arrangement, the crankcase member must support the sealing members and the lubricant pump in addition to the crankshaft. This assembly work was difficult and was more difficult with a vertical engine. However, in this arrangement, because the bearing cap supports the crankshaft, attaching the crankcase member onto the engine body can be done more easily.

Although this invention has been disclosed in the context of a certain preferred embodiments and variations thereof, it will be understood by those skilled in the art that the present invention extends beyond the specifically disclosed embodiments to other alternative embodiments and/or uses of the invention and obvious modifications and equivalents thereof. For instance, the openings can be omitted from the crankshaft bearing structure. The lubricant guide plate also can be omitted. In addition, the respective cap sections can be separately provided rather than being unified. The lubricant return passage can include both the passage formed behind the guide plate and the passage along the front surface of the plate. Thus, it is intended that the scope of the present invention herein disclosed should not be limited by the particular disclosed embodiments and variations described above, but should be determined only by a fair reading of the claims that follow.

What is claimed is:

1. An internal combustion engine comprising a cylinder body, a crankcase member defining a crankcase chamber with the cylinder body, a crankshaft extending within the crankcase chamber, and a bearing cap, the cylinder body including at least a first bearing portion, a second bearing portion, and an intermediate bearing portion between the first and second bearing portions, the crankcase member including a first bearing section and a second bearing section, the first bearing portion and the first bearing section cooperating to form a first main bearing journalling the crankshaft, the second bearing portion and the second bearing section cooperating to form a second main bearing journalling the crankshaft, the first and second main bearings being the only bearings journalling the crankshaft that are formed partially by the crankcase, the bearing cap including a cap section that cooperates with the intermediate bearing portion to form an intermediate main bearing which rotatably journals the crankshaft at a location between the first and second bearings, the bearing cap being attachable to the cylinder body apart from the crankcase member.

2. The internal combustion engine of claim 1, wherein the engine includes at least two intermediate bearing portions, the bearing cap includes at least two cap sections corresponding to the intermediate bearing portions, and the respective cap sections of the bearing cap being joined together.

3. The internal combustion engine of claim 1 additionally comprising a lubrication system, the lubrication system including a lubricant supply passage arranged to deliver lubricant at least to a space defined between the crankshaft and the first bearing portion, and the bearing cap is spaced from at least a portion of at least one wall of the crankcase member so as to define a lubricant flow path between the bearing cap and the crankcase member.

4. The internal combustion engine of claim 3, wherein the lubrication system includes a guide plate attached to an internal surface of the crankcase member so as to define a lubricant return passage.

5. The internal combustion engine of claim 3, wherein the lubricant supply passage, at least in part, is formed internally within the cylinder body.

6. The internal combustion engine of claim 1 additionally comprising at least three pistons and at least three connecting rods arranged to couple the crankshaft with the pistons, the crankshaft including at least a first connecting rod journal, an intermediate connecting rod journal and a lower connecting rod journal, each one of the connecting rods being rotatably connected to the respective first, intermediate, and second connecting rod journals, the first connecting rod journal being interposed between the first bearing section and the bearing cap, and the second connecting rod journal being interposed between the second bearing section and the bearing cap.

7. The internal combustion engine of claim 1, wherein the crankshaft is oriented in the engine so as to extend generally vertically within the crankcase, the first main bearing is arranged at an upper end of the crankcase, and the second main bearing is arranged at a lower end of the crankcase.

8. The internal combustion engine of claim 1, wherein the first main bearing is disposed at one end of the crankcase and the second main bearing is disposed at the other end of the crankcase.

9. A crankshaft bearing arrangement for an internal combustion engine having a cylinder body, a crankshaft having first and second ends, and a crankcase member, comprising a bearing cap and a plurality of fasteners, a first bearing unit being formed by the cylinder body, the crankcase member and some of the fasteners, the first bearing unit journalling the crankshaft only at the first and second ends of the crankshaft, and a second bearing unit being formed by the cylinder body, the bearing cap and the rest of the fasteners.

10. The crankshaft bearing arrangement of claim 9 additionally comprising a plurality of the second bearing units.

11. The crankshaft bearing arrangement of claim 10, wherein the bearing cap includes at least two cap sections, and the respective cap sections are joined together.

12. The crankshaft bearing arrangement of claim 9 wherein the second bearing unit is interposed between the first bearing units.

13. The crankshaft bearing arrangement of claim 9 additionally comprising a lubrication system, the lubrication system including a lubricant supply passage arranged to deliver lubricant to the first and second bearing units, and a lubricant return passage defined between the crankcase member and the bearing cap.

14. A method for supporting a crankshaft in an internal combustion engine which includes a cylinder body, a crankshaft, and a crankcase, the method comprising affixing a bearing cap to the cylinder body so as to rotatably journal the crankshaft between the cylinder body and the bearing cap and so as to define a gap between the bearing cap and the crankcase member, and affixing the crankcase member to the cylinder body so as to further rotatably journal the crankshaft between the cylinder body and the crankcase member, the cylinder body and crankcase member defining only two bearings disposed on opposite sides of the bearing cap.

15. The method of claim 14, wherein affixing the crankcase member to the cylinder body comprises defining first and second main bearing journals of the crankshaft between the cylinder body and the crankcase member.

16. The method of claim 14, wherein the crankcase member is affixed to the cylinder body after affixing the bearing cap.

17. The method of claim 16, wherein the affixing the crankcase member comprises positioning the crankcase member onto an end of the cylinder body with the bearing cap disposed between the cylinder body and the crankcase member, and fastening the crankcase member to the cylinder body.

18. The method of claim 17 additionally comprising spacing the crankcase member from the bearing cap so as to define a lubricant return passage.

19. The internal combustion engine of claim 1 additionally comprising a lubricant reservoir disposed lower than the lower bearing, and the lower bearing section defines a drain path of lubricant to the lubricant reservoir.

20. An internal combustion engine comprising a cylinder body, a crankcase member defining a crankcase chamber with the cylinder body, a crankshaft extending generally vertically within the crankcase chamber, at least three pistons, at least three connecting rods each coupled with each one of the pistons, the crankshaft having upper, intermediate and lower connecting rod journals to which the respective connecting rods are coupled, the cylinder body and the crankcase member together defining an upper bearing to journal a portion of the crankshaft which is located above the upper connecting rod journal, the cylinder body and the crankcase member further defining a lower bearing to journal a portion of the crankshaft which is located below the lower connecting rod journal, the upper and lower bearings being the only bearings formed partially by the crankcase member, a single bearing member defining a plurality of intermediate bearings together with the cylinder body to journal a plurality of portions of the crankshaft which are located next to the intermediate connecting rod journal, and a lubrication system arranged to lubricate the upper, lower and intermediate bearings, the lubrication system including a lubricant flow path defined at an inner surface of the crankcase member.

21. The internal combustion engine of claim 20, wherein the lubrication system includes a lubricant reservoir disposed lower than the lower bearing, and the lubricant returns to the lubricant reservoir after lubricating the upper, lower and intermediate bearings.

22. The internal combustion engine of claim 21, wherein the lubricant falls down to the lubricant reservoir generally along the inner surface of the crankcase member.

23. The internal combustion engine of claim 20, wherein a plate is attached to the inner surface of the crankcase member to substantially define the lubricant flow path between the plate and the inner surface of the crankcase member.

24. The internal combustion engine of claim 20, wherein a lubricant drain path is formed at a portion of the crankcase member that defines the lower bearing.

25. The internal combustion engine of claim 20, wherein the crankshaft has at least three intermediate connecting rod journals, and the single bearing member defines at least three intermediate bearing with the cylinder body.

* * * * *